United States Patent [19]

Castaldo

[11] Patent Number: 5,004,037

[45] Date of Patent: Apr. 2, 1991

[54] LONG SPAN SPRUE TUBE FOR INVESTMENT CASTING

[76] Inventor: Ronald Castaldo, 19 Pitts Ave., Mastic, N.Y. 11950

[21] Appl. No.: 390,104

[22] Filed: Aug. 7, 1989

[51] Int. Cl.[5] ..... B22C 7/02; B22C 9/04

[52] U.S. Cl. ..... 164/244; 164/34; 164/35; 249/54; 249/62

[58] Field of Search ..... 164/244, 246, 34, 35, 164/36, 45, DIG. 4; 249/54, 62

[56] References Cited

U.S. PATENT DOCUMENTS

| | | | |
|---|---|---|---|
| 3,340,923 | 9/1967 | Benfield | 164/244 |
| 3,610,317 | 10/1971 | Benfield et al. | 164/244 X |
| 4,081,019 | 3/1978 | Kulig | 164/244 X |
| 4,741,378 | 5/1988 | Engelman et al. | 164/244 |

*Primary Examiner*—Nicholas P. Godici
*Assistant Examiner*—J. Reed Batten, Jr.
*Attorney, Agent, or Firm*—Edward H. Loveman

[57] ABSTRACT

The tube is at least two inches long and has successive sections of progressively smaller diameters to produce a correspondingly shaped sprue passage communicating with a pattern cavity in a casting investment, so that fluid casting material passes with increasingly fluid velocity between an inlet and outlet of the sprue passage during the casting process. A bulbous portion of the tube is spaced from its free end, to form a reservoir chamber in the sprue passage, spaced sufficiently from the pattern cavity, so that casting material flowing through the sprue passage attains maximum velocity at the outlet of the passage entering the pattern cavity.

6 Claims, 2 Drawing Sheets

LONG SPAN SPRUE TUBE FOR INVESTMENT CASTING

BACKGROUND OF THE INVENTION

1. Field of the Invention

This invention relates to the art of investment casting of metal or plastic objects by the lost wax process such as generally used in dentistry, jewelry, manufacture, and other fields; and more particularly the invention concerns an improved, elongated, tapered, sprue tube structure for spanning a long or wide casting investment, to make possible casting entire intricate dental bridge, jewelry article, artifact, work of art, or other object in one piece.

2. Description of the Prior Art

The conventional lost wax casting process generally used in industry and the arts involves fabricating a wax model or pattern of the article to be cast. Then one or more short sprue tubes are attached to the pattern; and both pattern and sprue tubes are embedded in a plaster investment. The entire assembly is then placed in an oven and heated to approximately 1800° F. for a period of time until the pattern is burned out of the investment cast. The pattern cavity is then filled with a fluid casting material such as molten metal or thermosetting plastic via the sprue passages while the plaster investment is whirled in the centrifuge. After the pattern cavity is filled the assembly is cooled down and the plaster investment is broken away to release the cast article.

Heretofore when a rather large intricate object such as a dental bridge had to be cast in metal or plastic, it was generally cast in several sections which were then soldered or fused together to make the complete object. This involved a great deal of hand work which had to be done by skilled artisans. The entire process was long, laborious, and expensive. Pieces were often made oversize and were then ground down to desired dimensions. It was not possible to cast thin walled sections directly. They had to be made thicker than required and then they had to be machined down to required thinness. Often pieces were broken or damaged in the lengthy hand work process. Often cast pieces had to be discarded because they were found to have porous walls.

SUMMARY OF THE INVENTION

According to the invention, one or more long span sprue tubes are provided for attachment to wax pattern of a rather large, intricate article such as an entire dental bridge. The casting of the article is accomplished by the lost wax process explained above. After the pattern and sprue tubes are embedded in the plaster investment and then burned or melted out, fluid casting material is passed through the long sprue passage or passages in the plaster investment to produce the desired article in its entirety. This contrasts with the prior situation where the short sprue tubes provide short sprue passages which enable casting only small pieces or small sections of large articles. Thereafter these small sections have to be soldered or fused together to make the desired complete article.

A sprue embodying the present invention has a long thick outer cylindrical section with a wide axial bore or passage. A short tapered section is integral with one end of the outer section. A long inner cylindrical section is integral with the narrow end of the tapered section. The inner section terminates in a tapered tip. Spaced from the tip is a hollow bulbous portion of the inner section.

The entire sprue tube has an axial passage of narrow diameter extending through it from end to end. This structure makes possible long span direct spruing of investment castings without short sprues, gates, and other expedients heretofore used for indirect spruing. By direct spruing of the casting investment, rather large castings up to six inches in length and/or width, for example, can be made in one piece without requiring subsequent soldering or fusing together of small cast sections, as has been done heretofore.

These and other objects and many of the attendant advantages of this invention will be readily appreciated as the same becomes better understood by reference to the following detailed description when considered in connection with the accompanying drawings in which:

DESCRIPTION OF THE PREFERRED EMBODIMENT

Figure 1:
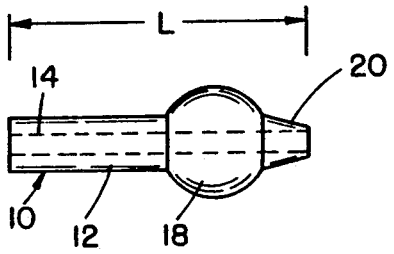
FIG. 1 PRIOR ART
FIG. 1 is a side elevational view of a conventional short sprue tube known in the prior art, shown on a magnified scale.

Referring now to the drawings wherein like reference characters designate like or corresponding parts throughout, there is illustrated in FIG. 1, a short sprue tube designated generally by reference numeral 10, of a type known in the prior art and widely used in casting of articles by the conventional and well known lost wax process. In actual practice such as used in dentistry, the tube 10 may have overall length L ranging from one half of an inch to about one inch. A short tube has heretofore been considered desirable to minimize the length of the sprue passage through which the molten metal must travel through the plaster investment to fill the pattern cavity therein. The tube 10 has a long cylindrical section 12 terminating with a bulbous portion 18. Integral with the bulbous portion is a very short tapered tip 20. Inside the tube 10 is an axial bore or passage 14 extending the full length thereof. The tip 20 is generally about ⅛ of an inch long. The bore is 3/64 to 1/16 of an inch in diameter. The tube section 12 is about ¼ to ½ inch long. The bulbous portion 18 is generally 3/16 to ¼ of an inch long axially of the tube 10.

When the sprue tube 10 is to be used, the tip 20 of the tube 10 is attached to a wax pattern (not shown). This may be done by using melted wax or by heating the end of the tip 20 and slightly embedding it in the wax pattern. For most of its short length, the tip 20 will be embedded in the wax pattern so that it is not replicated as a cylindrical passage in the plaster investment. The bulbous portion 18 at this time will be disposed adjacent to the wax pattern. While the sprue tube 10 is being burned out, the axial passage 14 will facilitate release of air, vapor pressure, and wax. The sprue tube 10 will burn out completely with the wax pattern from the plaster investment, to leave a short sprue passage in the plaster investment communicating with a cavity left by the burned out wax pattern. The short sprue passage will have a size and shape corresponding to the negative of the tube 10 and the pattern cavity will have a shape corresponding to the negative of the wax pattern burned out. The sprue passage in the plaster investment will have a length equal to the length of tube section 12 plus the axial length of a chamber left by a bulbous portion 18. This chamber will be adjacent to the pattern cavity and is considered necessary because it fills with the molten casting metal and serves as a reservoir while the metal enters the pattern cavity during centrifuging. The reservoir chamber left by bulbous section 18 serves as an enlargement of the narrow sprue passage in the plaster investment for preventing withdrawal of the molten metal when the casting is being cooled. The chamber 18 has a drawback in that it materially reduces the pressure and velocity under which the fluid casting material is forced into the pattern cavity in the plaster investment. Since the pressure is reduced, many fine, narrow spaces in the pattern cavity do not fill properly. Very thin pattern walls having a thickness of about 0.2 to 0.5 of a millimeter cannot be cast at all. Undesired porosity in the resulting metal casting often results due to the reduced pressure and velocity under which the metal flows into the pattern cavity in the plaster investment. Because of these conditions, use of the short tube 10 shown in FIG. 1 has been limited to make very small cast articles, or small sections of a large article. The small cast sections have to be soldered together afterwards to make the whole article.

Turning now to FIGS. 2–7 which illustrate the new and improved long span sprue tube embodying the invention, there is shown a sprue tube designated generally by reference numeral 25 which has an outer cylindrical first section 26 of uniform diameter D1 and extending from a free outer end 28 to a wider end 29 of a tapered, frustoconical section 30 integral with section 26. The section 30 tapers down to a narrower end 31 where it is integral with a cylindrical third section 32 having a diameter D2 which is about one half of the diameter D1. The section 32 extends to a spherically curved or bulbous integral fourth section 34 which has a diameter slightly larger than diameter D1 of the section 26. Extending from the section 34 and integral therewith is a tapered fifth section or tip 36 whose free end 40 has a diameter which is at least half of the diameter D2. The tip 36 is substantially longer axially than tapered tip 20 of the sprue tube 10 shown in FIG. 1.

In a preferred form such as used in dental casting of bridges, the overall length L′ of the tube 25 is at least two inches. The section 26 is at least ¾ of an inch long; the tapered section 30 is about ¼ of an inch long axially; the section 32 is about ½ of an inch long axially; the section 34 is about ¼ of an inch long axially; section 36 (L1) is at least ¼ of an inch long axially. The outside diameter D1 is about ⅜ of an inch and the diameter D2 is about ¼ of an inch. As mentioned above, the length of the end section or tapered tip 36 is about ⅜ of an inch. This last dimension contrasts with the structure of the short tip 20 in the prior sprue tube 10, which is not more than ⅛ of an inch in axial length. The tube 25 has a narrow passage 42 extending entirely through the tube axially from end to end. The tube 25 is made of wax, a thermoplastic, or a combustible material, so that the tube 25 will melt and run out of a plaster investment, or will burn out completely when subjected to high temperature in an oven.

Figure 7:
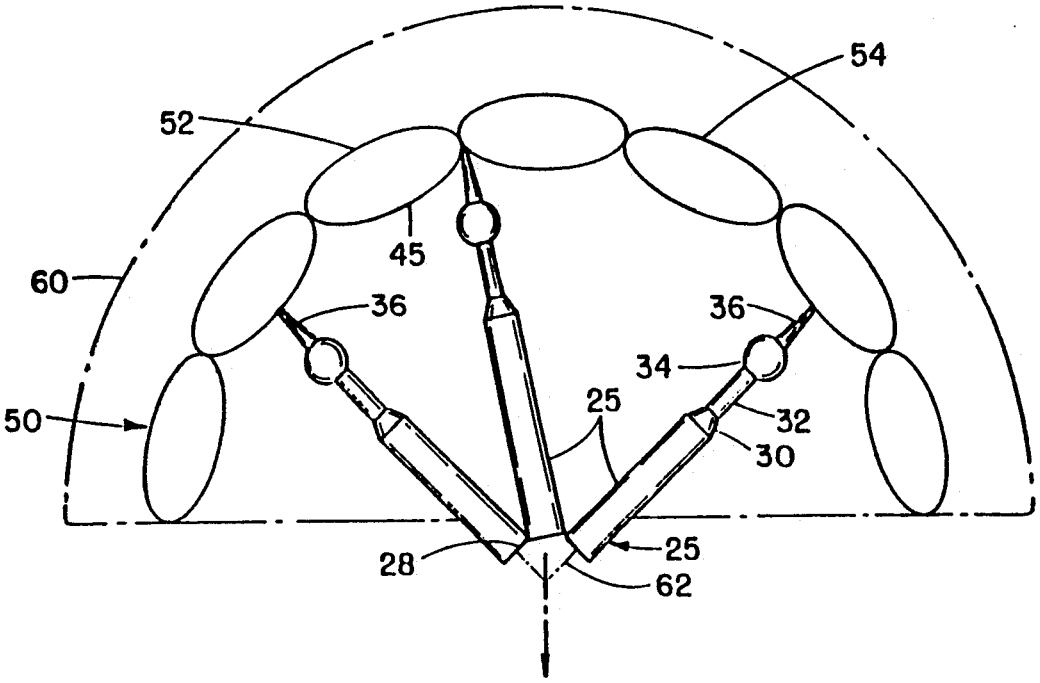
FIG. 7 is a top view of a large wax pattern with a plurality of long span sprue tubes at a stage in an investment casting process.

FIG. 7 illustrates one use of the invention. In one stage of the casting process two, three or more of the sprue tubes 25 are disposed in an angular or fanlike coplanar array. The outer ends 28 are disposed adjacent to each other. The tips 36 are stuck to a side 45 of a wax or plastic horseshoe shaped pattern 50. This may be accomplished by heating each tube tip 36 and then applying the end 40 to the pattern 50 at a desired point. Upon cooling, the tip 36 will adhere to the pattern 50 which may have a plurality of very thin sections 52, as thin as 0.2 of a millimeter. Thicker portions 54 may range up to ¼ of an inch in thickness. The entire assembly of tubes 25 and the pattern 50 are then enclosed in a plaster investment 60 (indicated by dotted lines) leaving exposed the free ends 28 of all sprue tubes 25.

Figure 8:
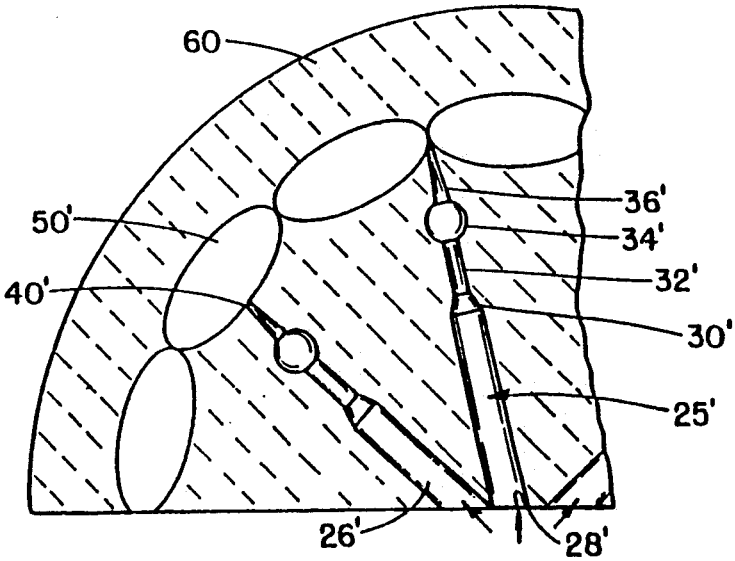
FIG. 8 is a top sectional view of part of a plaster investment with pattern cavity and sprue passages made by means of the pattern and sprue tubes of FIG. 7.

After the investment plaster has set hard, the assembly is placed in an oven and heated to a temperature as high as 1800° F. to cause the pattern 50 and the sprue tubes 25 to melt and/or burn out as indicated by dotted lines 62. This will leave the pattern cavity 50′ and sprue channels or passages 25′ in the plaster investment 60 as shown in FIG. 8. The pattern cavity 50′ will be a precise negative of the pattern 50 and the sprue channels or passages 25′ will be precise negatives of the portions of the tubes 25 which were embedded in the plaster investment 60. The passages 25′ all communicate with the cavity 50′ at openings 40′.

It will be noted that in each of the passages 25′, there is an outer end section having an opening 28′ through which molten casting metal or plastic can be injected into the passage 25′. The passage has two dimensional stages. The outer stage is defined by the passage portion 26′ of larger diameter and the inner stage by passage or channel portions 32′ and 36′ of smaller diameter. Spherical chambers 34′ located in the second stage portion serve as reservoirs for molten casting material and prevent discontinuities in the metal flow which could cause porosity in the final metal casting. The outer wider stage has a smooth transition to the narrower second stage via the tapered channel or passage portion 30′. This insures smoothness of metal flow without turbulence which could cause defects in the casting. When the molten casting material flows through the passages 25′, the velocity and pressure and resultant driving force increases in the second stage due to the progressive narrowing of the passage. The velocity, driving force and pressure are further increased as the molten casting material passes the constricted opening 40′. The fine streams of molten material leaving the openings 40′ rapidly penetrate to all points in the cavity 50′ even to and through the most constricted or narrow spaces such as narrow spaces 52′. This two stage sprue channel or passage 25′ produced by the novel shape of the sprue tube 25 is a critical feature of the invention and contrasts with the short sprue channel of the prior sprue tube 10 where enhanced or increased velocity of the casting metal does not occur. A further feature of the present invention is the long spacing of reservoir 34′ from the opening 40′ produced by the spacing of the bulbous section 34 from the tip 36 in the tube 25. In the use of the prior tube 10 the bulbous section 18 is disposed adjacent or against the wax pattern in the investment so that the sprue channel enlarges rather than constricts at the opening in the pattern cavity. Thus in the use of the prior tubes 10 reduced driving pressure and velocity of the casting metal, results in porosity in the castings, and makes impossible the production of castings having very thin spaces, interstices and details. The long span of the new sprue tube 25 makes possible direct long span sprue fabrication of castings without use of gates, bypasses, or other expedients heretofore used. The present invention makes it possible to cast an entire dental bridge at one time. This full mouth bridge will not have and will not require solder joints, seams or other means to join together several small cast sections as has heretofore been the practice. The present invention thus reduces the labor, time, and expense in casting an intricate article, and at the same time it produces a stronger, more long lasting, seamless, one-piece casting.

Figure 2:
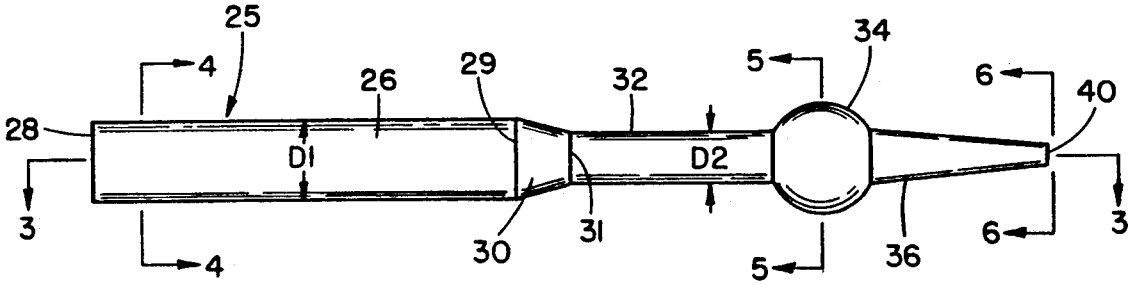
FIG. 2 is a side elevational view of an elongated sprue tube embodying the invention, and shown on the same scale as that of FIG. 1.
Figure 3:
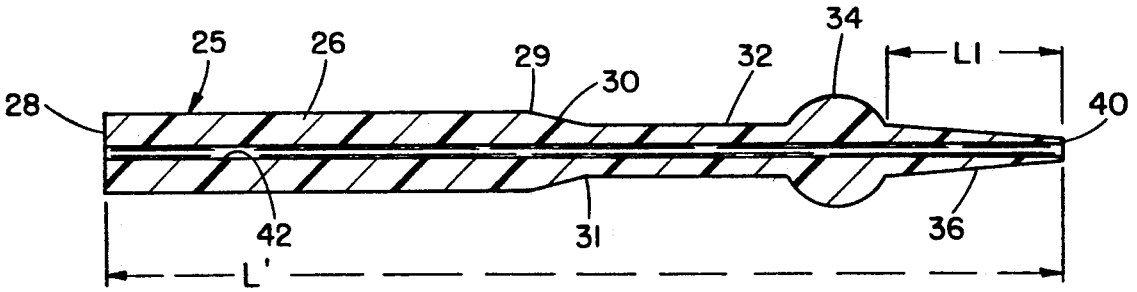
FIG. 3 is an axial sectional view taken along line 3—3 of FIG. 2.
Figure 4:
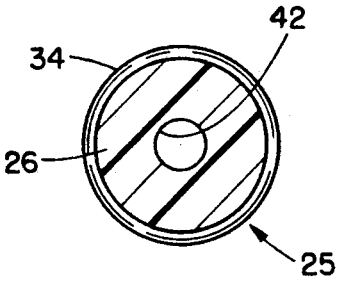
FIGS. 4 and 5 are cross sectional views on a further enlarged scale taken along lines 4—4 and 5—5 of FIG. 2.
Figure 5:
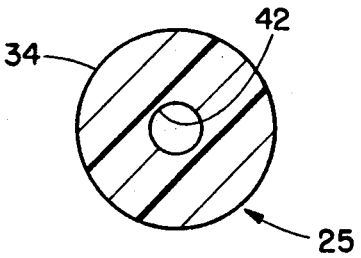
Figure 6:
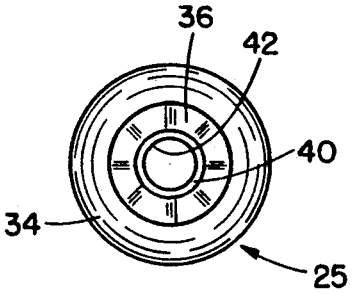
FIG. 6 is an end elevational view taken along line 6—6 of FIG. 2 on the same scale as that of FIGS. 4 and 5.
Figure 9:
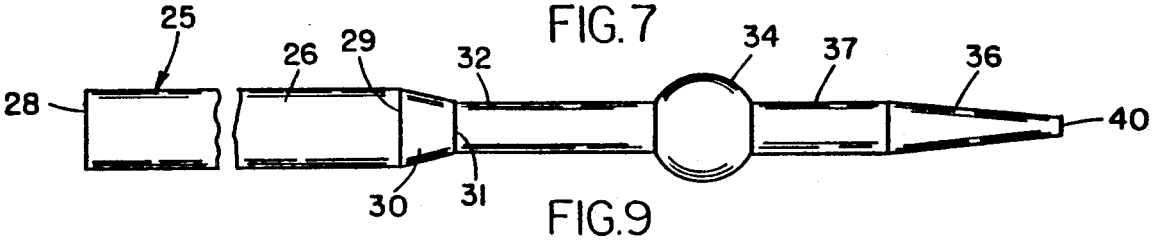
FIG. 9 is a side elevational view of an elongated sprue tube illustrating an alternate embodiment of the invention.

There is illustrated in FIG. 9 an alternate embodiment of the present invention comprising a sprue tube identical to the sprue tube illustrated in FIG. 2 and further including a short cylindrical section 37 inserted between the bulbous section 34 and the tapered section 36 to provide a smoother transition therebetween.

It should be understood that the foregoing relates to only a preferred embodiment of the invention which has been by way of example only, and that it is intended to cover all changes and modifications of the examples of the invention wherein chosen for the purpose of the disclosure, which do not constitute departures from the spirit and scope of the invention.

What is claimed is:

1. A long span sprue tube forming a sprue passage in a casting investment to pass a fluid casting material into a pattern cavity in said casting investment, comprising:

a cylindrical first section having a first outside diameter, a free first end and an axially spaced second end;

a tapered second section having a wider end and an axially spaced narrower end, said wider end being equal in diameter to said first diameter and integral with said second end of said first section, said narrower end having a second outside diameter smaller than said first outside diameter;

a cylindrical third section having axially spaced third and fourth ends, said third end being integral with said narrower end of said tapered section, said third section having a uniform diameter equal to said second diameter;

a bulbous portion formed integrally with said fourth end, said bulbous portion forming a chamber constituting a reservoir for said casting material in said sprue passage, said bulbous portion having a fifth end spaced from said fourth end; and a tapered tip section integral with said fifth end and having a free end adapted for attachment to a pattern prior to embedment thereof in said casting investment, all of said sections being disposed in axial alignment to form an axially straight sprue passage in said casting investment communicating with said pattern cavity therein when said pattern and said sprue tube sections are all burned out of said casting investment, whereby said fluid casting material can flow smoothly without turbulence through said sprue passage to said pattern cavity, and whereby velocity of said casting material entering said sprue passage increases in successive steps in said sprue passage, until said casting material reaches said pattern cavity to fill the same completely.

2. A long span sprue tube as claimed in claim 1, wherein said tube has an axial length of at least two inches to enable casting an entire dental bridge in one piece in said pattern cavity.

3. A long span sprue tube as claimed in claim 2 wherein said bulbous portion is spaced at least one quarter of an inch from said free end of said tapered tip section so that said chamber is correspondingly spaced from said pattern cavity, and so that said sprue passage has an outlet of minimum size at said pattern cavity to maximize said velocity of said casting material tnereat.

4. A long span sprue tube as claimed in claim 3 wherein said tube has an axial bore extending through all of the tube sections to facilitate complete removal of said sections from said casting investment to form said sprue passage.

5. A long span sprue tube as claimed in claim 4 wherein said tapered tip section has a minimum diameter of not less than one eighth of an inch, so that said sprue passage has corresponding dimensions to facilitate removal of said pattern from said casting investment through said sprue passage during heating and centrifuging in a lost wax casting process.

6. A long span sprue tube as claimed in claim 1, further including a cylindrical section between said bulbous section and said tapered tip section to provide a smooth transition thereinbetween.

* * * * *